US006371098B1

(12) United States Patent
Winther

(10) Patent No.: US 6,371,098 B1
(45) Date of Patent: Apr. 16, 2002

(54) SPLIT LIMB COMPACT ARCHERY BOW

(76) Inventor: Howard A. Winther, 120 Saratoga Ave., Suite 82, Santa Clara, CA (US) 95051

( * ) Notice: Subject to any disclaimer, the term of this patent is extended or adjusted under 35 U.S.C. 154(b) by 0 days.

(21) Appl. No.: 09/649,722

(22) Filed: Aug. 28, 2000

Related U.S. Application Data

(60) Provisional application No. 60/164,919, filed on Nov. 15, 1999.

(51) Int. Cl.[7] ..... F41B 5/00; F41B 5/10

(52) U.S. Cl. ..... 124/23.1; 124/24.1; 124/25.6; 124/44.5; 124/88

(58) Field of Search ..... 124/23.1, 24.1, 124/25.6, 44.5, 86, 88

(56) References Cited

U.S. PATENT DOCUMENTS

| | | | | | |
|---|---|---|---|---|---|
| 4,644,929 | A | | 2/1987 | Peck | |
| 4,759,337 | A | * | 7/1988 | Suski | 124/88 X |
| 5,113,841 | A | * | 5/1992 | Bratcher | 124/23.1 |
| 5,280,779 | A | | 1/1994 | Smith | 124/88 |
| 5,429,106 | A | | 7/1995 | Martin et al. | 124/23.1 |
| 5,623,915 | A | * | 4/1997 | Kudlacek | 124/25.6 |
| 5,649,519 | A | * | 7/1997 | Linderman | 124/23.1 |
| 5,687,703 | A | * | 11/1997 | Vyprachticky | 124/25.6 |
| 5,720,267 | A | | 2/1998 | Walk | 124/23.1 |
| 5,722,380 | A | | 3/1998 | Land et al. | 124/25.6 |
| 5,762,060 | A | | 6/1998 | Larson | 124/88 |
| D397,757 | S | | 9/1998 | Ferrante | D22/107 |

* cited by examiner

*Primary Examiner*—John A. Ricci
(74) *Attorney, Agent, or Firm*—Townsend and Townsend and Crew LLP; Kenneth R. Allen

(57) ABSTRACT

A compound or recurve bow has split limbs mounted to limb pockets which are on pivots connected to a handle riser wherein the riser provides an arrow slot between the upper limbs so the arrow is launched from between the upper limbs. The result is an effective compound or recurve archery bow which is more compact and comparatively lighter than heretofore known.

7 Claims, 2 Drawing Sheets

SPLIT LIMB COMPACT ARCHERY BOW

CROSS-REFERENCES TO RELATED APPLICATIONS

This application claims priority of United States Provisional Patent Application Ser. No. 60/164,919 filed Nov. 15, 1999.

BACKGROUND OF THE INVENTION

This invention relates to archery and in particular to compound and traditional recurve bows. Heretofore, the compound and recurve bows have required a relatively large span to achieve adequate flexibility and strength. However, weight and size are a continuing challenge. Archery bows have been relatively cumbersome due to their long span. What is needed is a more compact bow.

Examples of prior art patents with the accuracy and power of larger compound and recurve bows are U.S. Pat. Nos. 5,762,060, 5,722,380, 5,720,267, 5,429,106, 5,280,779, 4,644,929 and D397,757. None has suggestion of the present invention.

SUMMARY OF THE INVENTION

According to the invention, a compound or recurve bow has split limbs mounted to limb pockets which are on pivots connected to a hand riser wherein the riser provides an arrow slot between the upper limbs so the arrow is launched from between the upper limbs. The result is an effective compound or recurve archery bow which is more compact and comparatively lighter then heretofore known.

This invention will be better understood by reference to the following detailed description in conjunction with the accompanying drawings.

DESCRIPTION OF SPECIFIC EMBODIMENTS

Figure 1:
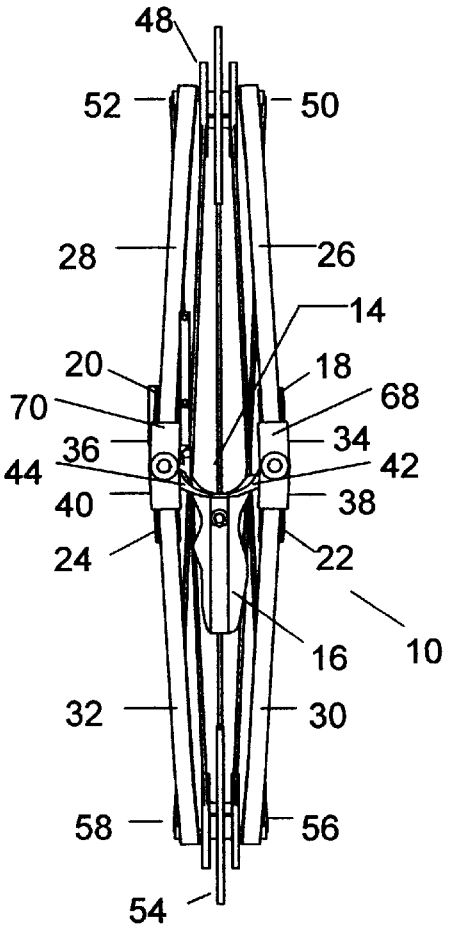
FIG. 1 is a front view of a compound archery bow with split limb mounting according to the invention.

Referring to FIGS., 1, 2, 3, 4, 5 and 6 there is shown a compound and recurve archery bow 10, 11 and its common part 9. A handle riser 12 has an arrow slot 14 and a handle 16, as well as pivot-mounted rotating mounts 18, 20, 22, and 24 for removable limbs. There are first and second upper bow limbs 26, 28 and first and second lower bow limbs 30, 32. The first and second upper bow limbs 26, 28 are attached to the rotating bases 18, 20, called limb pockets, which in turn are pivotally attached to their bases 34, 36 and to handle riser mounts 42 and 44 at opposing sides of the arrow rest 14. Thus an arrow is mounted for launching from between the limbs 26, 28. The bow limbs are constructed of preferably composite fiber.

The lower bow limbs 30, 32 are mounted at their lower rotating bases 22, 24, which in turn are pivotally attached to their bases 38, 40 and to handle riser mounts 42, 44. The lower limbs 30, 36 may also be split, with the lower bases 38, 40 disposed adjacent the upper bases 34, 36. An adjusting cap 68, 70 allows rotation of mounts 18, 20 22 and 24 for draw force adjustment.

As with other compound bows, a pulley-cam assembly is provided comprising an upper tip pulley cam 48 attached at upper tips 50,52 of the first and second upper bow limbs 26, 28 and a lower tip pulley cam 54 is provided which is attached to lower tips 56, 58 of the first and second lower bows limbs 30,32. A split bowstring and cable assemble 60 is strung between the upper tip cam 48 and the lower tip cam 54. The split power cable assembly was chosen over the more conventional cable guard assembly due to excessive side torque on the cables caused by the short distance between the cams.

In operation, the bowstring 62 engages the nock of an arrow (not shown) resting in an arrow rest 14, according to the invention, is disposed to be launched between the upper limbs 26, 28.

Figure 5:
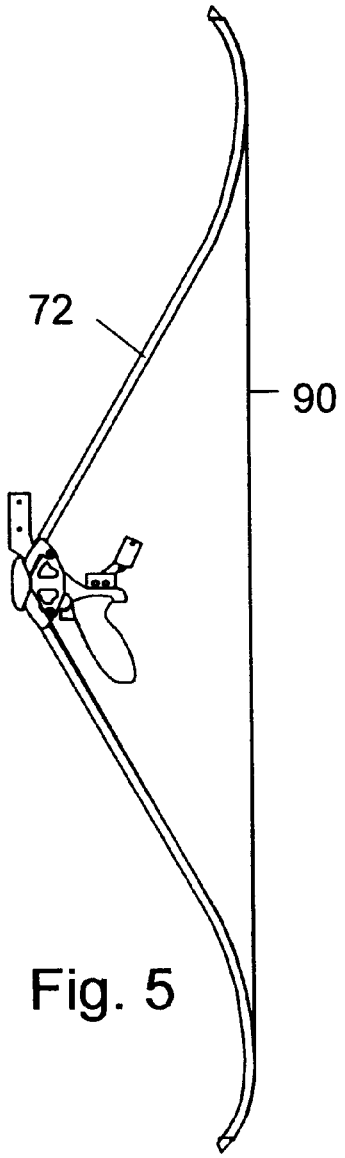
FIG. 5 is a side view of a recurve archery bow according to the invention.
Figure 6:
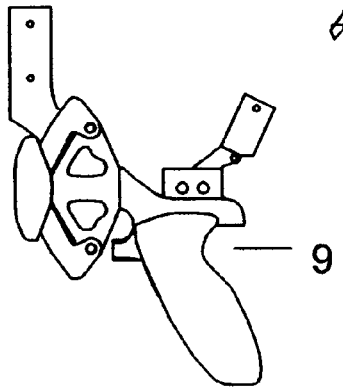
FIG. 6 is the side view of the riser common to both the compound and recurve bow.

Similarly in FIG. 5, the recurve bow 11 and recurve upper limbs 72, 74 are mounted, as are limbs 26, 28 in an identical or similar riser assembly 9. The tips of the upper limbs 76, 78 are joined together by the bow string loop and aligned by an interior shaft 80. The bottom half of the recurve may be identical to the upper half.

Figure 2:
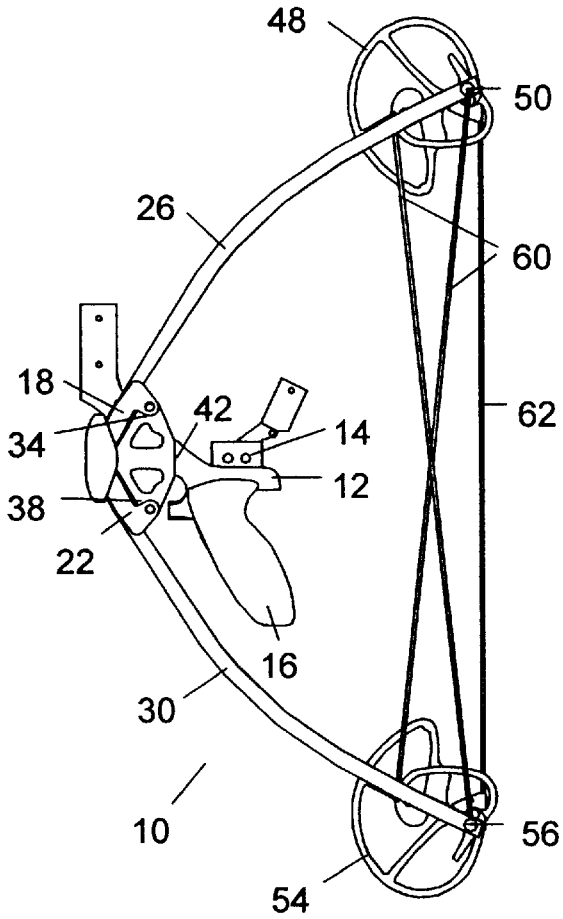
FIG. 2 is a side view of a compound archery bow according to the invention
Figure 3:
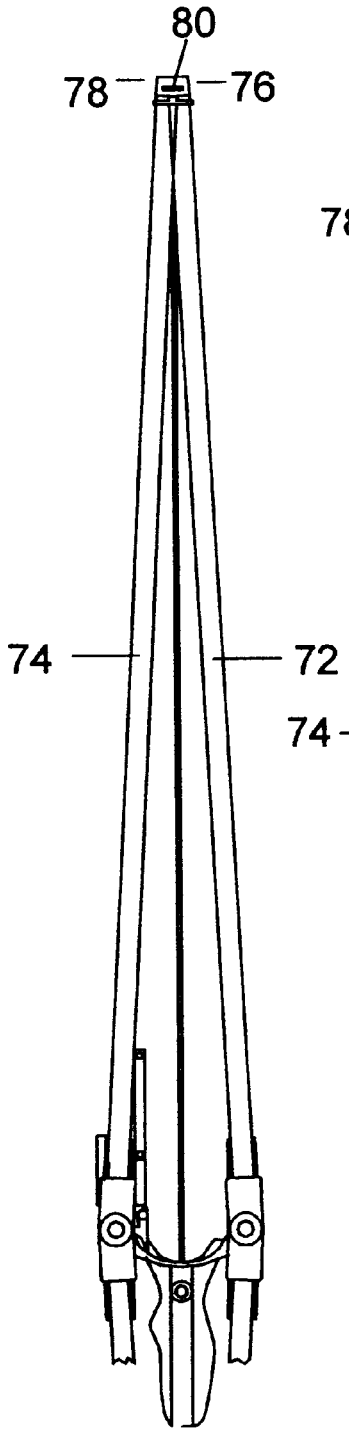
FIG. 3 is a front view of a recurve archery bow with split limb mounting.
Figure 4:
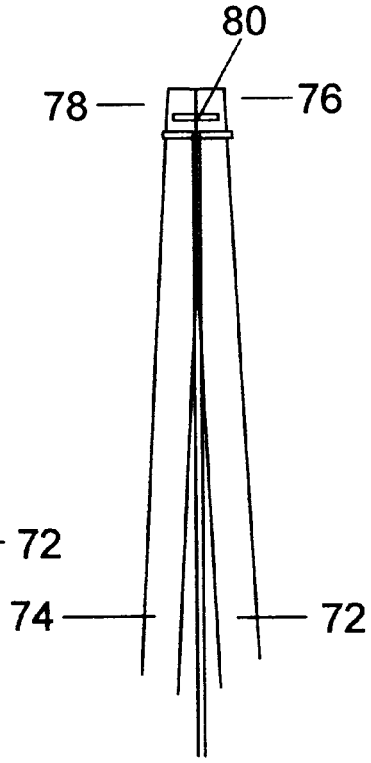
FIG. 4 is a expanded view of the recurve archery bow tip.

In the compound bow structure (FIG. 2) a pulley-cam assembly includes an upper tip pulley-cam 48 attached to the upper tip 50 of said first and second upper bow limbs and a lower tip pulley-cam 54 attached to the lower tip 56 of said first and second lower bow limbs and each pulley-cam has a draw cam and a pair of power cams, the power cams each having a pulley string attached to the opposing tip, so the pulley strings are on either side of the path for an arrow from said bowstring to said arrow slot.

The invention has been explained with reference to a specific embodiment. Other embodiments will be apparent to those of ordinary skill in the art. It is therefore not intended that this invention be limited except as indicated by the appended claims. For example, the scope of the invention is not limited to recurve or compound limbs, since the structure may also be employed with straight limbs or with complex limb flexing configurations.

What is claimed is:

1. A compound archery bow comprising:

a handle riser having an arrow slot and a handle;

first and second upper bow limbs each having an upper tip and a base, said bases each attached to said handle riser at opposing sides of said arrow slot.

2. The bow according to claim 1 having first and second lower bow limbs wherein said first and second lower bow limbs are mounted at split bases and adjacent said bases of said upper bow limbs.

3. The bow according to claim 2 wherein the first and second lower bow limbs define a lower tip, and further comprising:

a bowstring and cable assembly strung between said upper tips and said lower tip; and a pulley-cam assembly having an upper tip pulley-cam attached to said upper tips of said first and second upper bow limbs and a lower tip pulley-cam attached to said lower tip and each pulley cam comprising a draw cam and a pair of power cams, each said power cam having a pulley string attached to the opposing tip, said pulley strings being on either side of the path for an arrow from said bowstring to said arrow slot.

4. The bow according to claim 1 having first and second lower bow limbs, wherein said first and second lower bow limbs form a lower tip, wherein said first and second upper bow limbs and said first and second lower bow limbs are continuous elements through contiguous bases between said upper tip and said lower tip.

5. The bow according to claim 1 wherein at least a first lower bow limb is mounted with a base at a split base mount in said handle riser and adjacent said bases of said upper bow limbs.

6. A recurve archery bow comprising:

a handle riser having an arrow slot and a handle;

first and second upper bow limbs each having an upper tip and a base, said upper tips being joined, said bases each attached to said handle riser at opposing sides of said arrow slot and being spread relative to said upper tips.

7. An archery bow comprising:

a riser;

an arrow rest slot on the riser; and first and second upper bow limbs each having a lower end, wherein the lower ends of the upper bow limbs are mounted to the riser on opposing sides of the arrow slot.

* * * * *